United States Patent [19]

Dürselen et al.

[11] Patent Number: 4,732,652

[45] Date of Patent: Mar. 22, 1988

[54] CLAMPING SYSTEM FOR COKE OVEN HEATING WALLS

[75] Inventors: Heinz Dürselen; Jürgen Neitzel; Arnulf Schüffler; Walter Stanke, all of Essen, Fed. Rep. of Germany

[73] Assignee: Krupp Koppers GmbH, Essen, Fed. Rep. of Germany

[21] Appl. No.: 38,428

[22] Filed: Apr. 14, 1987

Related U.S. Application Data

[63] Continuation of Ser. No. 655,993, Sep. 28, 1984, abandoned, which is a continuation of Ser. No. 320,717, Nov. 12, 1981, abandoned.

[30] Foreign Application Priority Data

Nov. 28, 1980 [DE] Fed. Rep. of Germany ..... 3044897

[51] Int. Cl.[4] ..... C10B 29/04; C10B 29/08

[52] U.S. Cl. ..... 202/268; 52/573; 202/223; 202/270; 432/251; 432/252

[58] Field of Search ..... 202/222, 223, 267 R, 202/268, 270; 52/573; 432/251, 252

[56] References Cited

U.S. PATENT DOCUMENTS

| | | | |
|---|---|---|---|
| 1,426,748 | 8/1922 | Lewis et al. | 202/222 |
| 3,175,961 | 3/1965 | Olsen | 202/223 |
| 3,190,818 | 6/1965 | Otto | 202/268 |
| 3,247,079 | 4/1966 | Wethly | 202/223 |
| 3,259,551 | 7/1966 | Thompson | 202/268 |
| 3,295,280 | 1/1967 | Ketiner | 52/573 |
| 4,369,032 | 1/1983 | Lowrance et al. | 52/573 |
| 4,398,999 | 8/1983 | van Laar et al. | 202/267 R |

FOREIGN PATENT DOCUMENTS

| | | | |
|---|---|---|---|
| 1421020 | 10/1968 | Fed. Rep. of Germany | 202/268 |
| 2709631 | 9/1978 | Fed. Rep. of Germany | 202/268 |
| 2004470 | 11/1969 | France | 432/252 |
| 862 287 | 3/1961 | United Kingdom | 202/223 |
| 561861 | 6/1977 | U.S.S.R. | 432/251 |

*Primary Examiner*—Barry S. Richman
*Assistant Examiner*—Joye L. Woodard
*Attorney, Agent, or Firm*—Michael J. Striker

[57] ABSTRACT

A clamping system for preventing detrimental tensile and shearing stresses in heating walls used for example as partitions in industrial furnaces, comprises clamping plates adjoining opposite end faces of a heating wall plate, yoke-shape beams facing each clamping plate and interconnected by cross tie rods, and pressing elements between the beams and the clamping plates. The bias of the pressing elements is adjusted so as to decrease from the center of the clamping plate towards the upper and lower edges of the heating wall plate, the material of respective clamping elements being selected such as to keep the interfering forces within the limits of 5 to 20% of the original clamping forces, the resultants of the clamping forces being directed to the marginal area of each clamping plate, and the roughness in excess of 2.5 millimeters between the clamping plate and the heating wall plate being reliably compensated.

17 Claims, 39 Drawing Figures

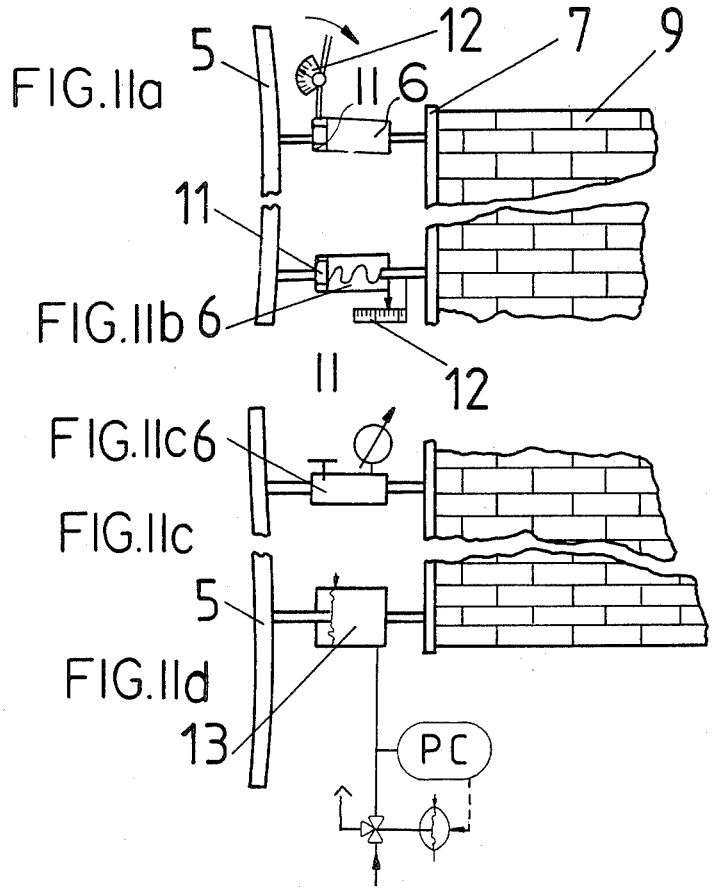
FIG.11a
5
12
7
9
11
6
11
FIG.11b
6
12
11
FIG.11c
6
FIG.11c
5
FIG.11d
13
PC
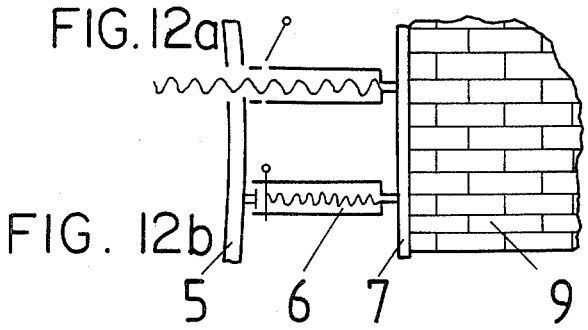
FIG. 12a
FIG. 12b
5
6
7
9 a b

FIG.20a
FIG.20b
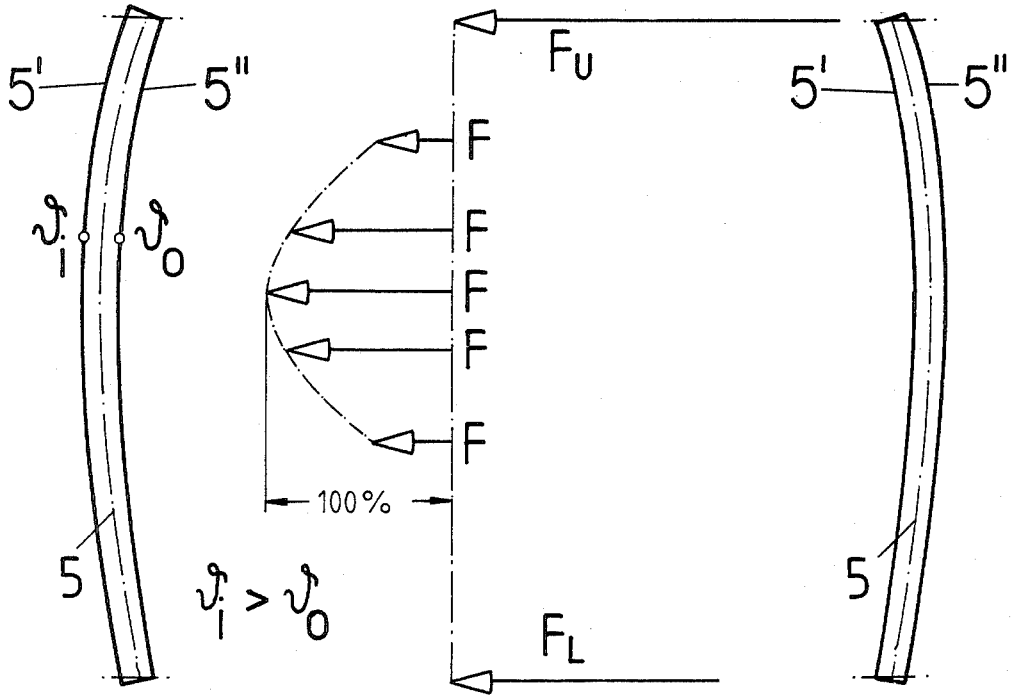
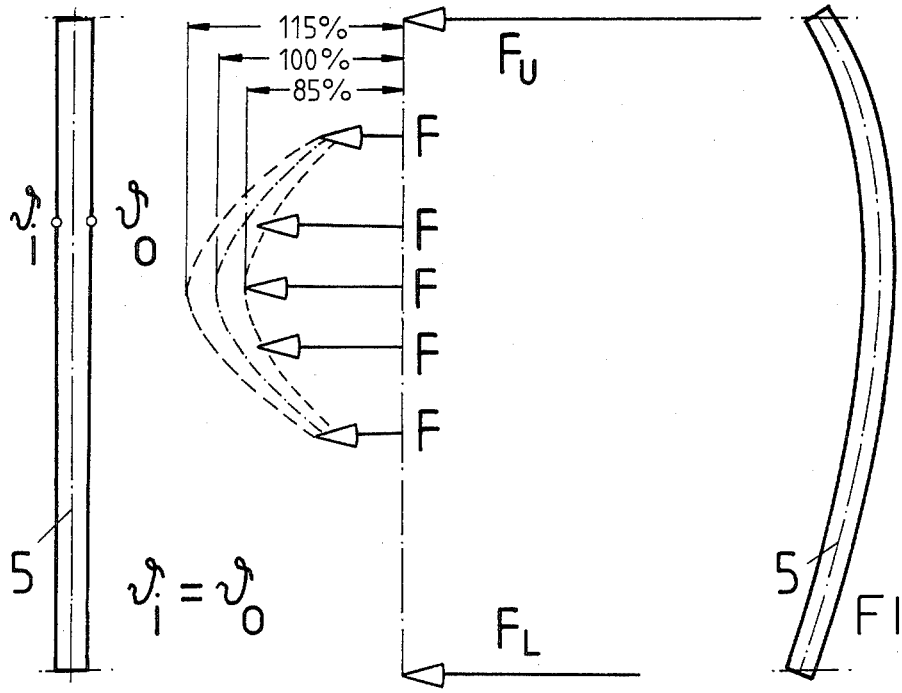
FIG.20c
FIG.20d

CLAMPING SYSTEM FOR COKE OVEN HEATING WALLS

This application is a continuation of Ser. No. 655,993, filed on Sept. 28, 1984, now abandoned, which is in turn a continuation of Ser. No. 320,717, filed on Nov. 12, 1981, now abandoned.

BACKGROUND OF THE INVENTION

The present invention relates in general to a protection system for one-layer or multi-layer brick walls, such as brick wall partitions in industrial furnaces, particularly heating walls in coke ovens or coke-oven-type industrial furnaces, which are subject both to thermal and mechanical loads and deformations. In particular, this invention relates to a clamping system for preventing such tensile and shearing stresses in the brick wall partitions of this kind, the system including clamping plates adjoining opposite faces of a brick wall partition, cross tie rods by means of which clamping forces are applied against the clamping plates by means of yoke-shaped beams and interposed springs or spacer pieces. In the following text; the terms a "brick wall" or a "brick wall partition" or a "brick wall plate" are interchangeable with the term "a heating wall in a coke-oven-type industrial furnace".

In larger surfaces of brick wall partitions, the unavoidable thermal and mechanical deformations increase proportionally with the second or higher power of the height of the brick wall partition, that is in an excessive proportion to the height of the brick wall partition. As a consequence, if the clamping system designed for such increased forces is correspondingly more rigid, the changes in temperature and in operational loads result in uncontrollable regrouping or rearrangement of clamping forces, which frequently attain extreme and unacceptable values; that is, the brick wall partition is subject to excessive loads at some points, whereas at other points insufficient clamping forces are present. Due to these differences, undue stresses are generated.

SUMMARY OF THE INVENTION

It is therefore a general object of the present invention to overcome the aforementioned disadvantages.

More particularly, it is an object of the invention to provide a clamping system which ensures an increased operational life of the brick wall partition by preventing the formation of cracks and tears therein.

Another object of this invention is to facilitate the application of larger, higher and thinner brick wall partitions.

By increasing the effective volume of furnaces and ovens, and by improving the operational life and maintenance expenditures, a substantial improvement in economy is obtained.

A further object of the invention is to generate and continuously maintain a sufficient prestress in the brick wall partitions which, despite varying thermal and mechanical deformations, prevents the formation of fissures or cracks due to tensile stresses.

In keeping with these objects and others which will become apparent hereafter, one feature of the invention resides, in a clamping system of the above described type, in the provision of cross tie rods, upright yoke-shaped beams and intermediate resilient or spacer elements between the yoke-shaped beams and the clamping plates which fulfill at least one of the following conditions:

(a) Clamping forces applied approximately midway between the upper and lower edges of the face of the brick wall partition adjoining the clamping plate decrease toward respective edges over a length of about 75% of the height of the brick wall partition according to a bell-shaped or parabolic characteristic curve or according to curve meeting the equation $$F=(AL^2+BL+C)^{-1}$$

wherein F is applied force and L is a half length of the surface portion between the edges;

(b) The resultants of the clamping forces in each half of the brick wall partition when viewed in longitudinal direction thereof act on midlines of two marginal areas of the brick wall partition or on intermediate planes of the outer layers of the brick wall partition these marginal areas having a width of approximately 65 mm, and the forces act at angles when considered in the longitudinal direction of the brick wall partition in the range between zero and 30°. When the forces act at a sharp angle relative to the central plane of the brick wall partition, the force vectors intersect in a line which is approximately parallel to the clamping plate;

(c) The effect of interfering local forces in the event of any disturbance is resiliently held within the limits of 5 to 20% of the preset clamping forces so as to maintain the desired distribution of the clamping forces over the whole clamping plate. This maintenance of the desired distribution of the clamping forces within narrow tolerances for all possible disturbances is achieved by the appropriate construction and arrangement of the cross tie rods, yoke-shaped beams, the clamping plates, and the intermediate pressing elements;

(d) Local roughness in excess of 2.5 mm in height is resiliently compensated by the selection of resilient or deformable materials which equalize these unevenesses of the mating surfaces resulting from manufacturing tolerances.

In the system of this invention, the above objects are attained by optimization of the flow of forces transmitted from the cross tie rods to the yoke-shaped beams, the intermediate resilient or spacer elements, and the clamping plates. At a lateral loading of the surfaces of the brick wall partition, the latter arches more strongly midway of its height. In order to achieve the most stabilizing effect particularly at this central region of the brick wall partition and to prevent any cracks of the brick wall partition, both in the surfaces and in its core, the largest clamping forces are applied to the center of the height of the brick wall partition, and the surfaces under attack by these forces are spaced apart laterally as far as possible to coincide with relatively narrow outer marginal zones of the end faces of the brick wall partition, whereby the resultants of the forces acting against these marginal zones are directed parallel to a center plane of the brick wall partition.

In order to preserve the desired pressure distribution under all kinds of interferences, the individual structural elements of the clamping system of this invention are made of materials having such an elastic quality as to compensate for the intefering influences.

The advantage of the springiness of the clamping system is in achieving a negligible offsetting of the force distribution on the one hand, and, particularly in brick wall partitions of larger size, in an easier and cheaper construction.

The desired distribution of clamping forces over the entire length of the clamping plate can be made either by the gradation of the thickness of the spacer pieces or by installing between the yoke-shaped beams and the clamping plates relaxed springy elements which are subsequently stressed by the cross tie rods or by the thermal expansion in the furnace; or, in the so-called step-in process, immediately by the springy spacer elements which are installed in a prestressed blocked condition and the support of which is adjusted in such a manner that, upon the removal of the blocking, the desired force distribution takes effect; or, in the so-called two-step method, the predetermined local clamping forces are applied accurately by means of one or more mechanical, hydraulic or pneumatic tensioning elements applying predetermined local clamping forces, and thereupon the distribution of these forces is effected by the adjustment of intermediate pressing elements such as the spacer pieces.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawings.

Figure 10:
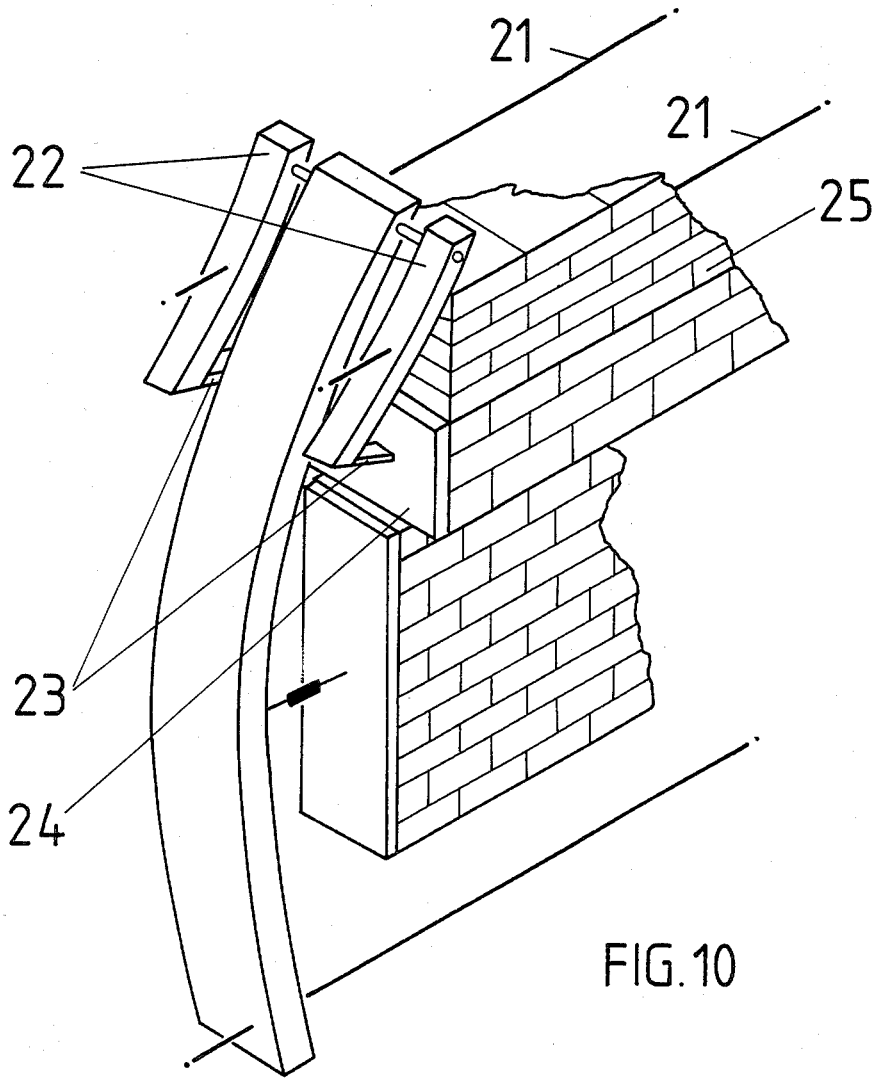
Figure 13:
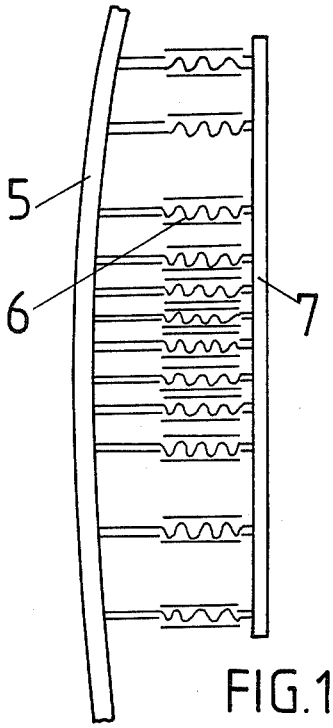
Figure 14:
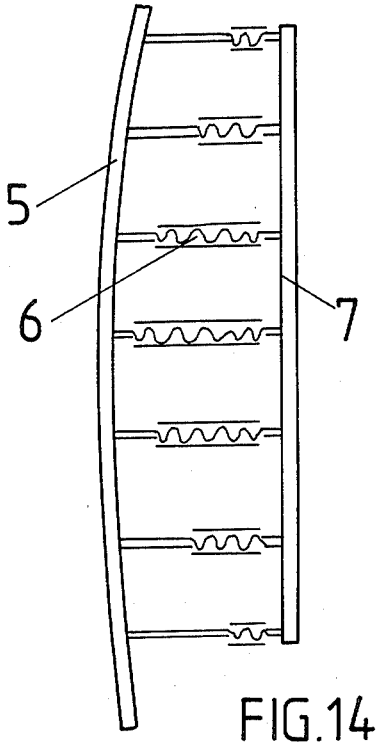
Figure 15:
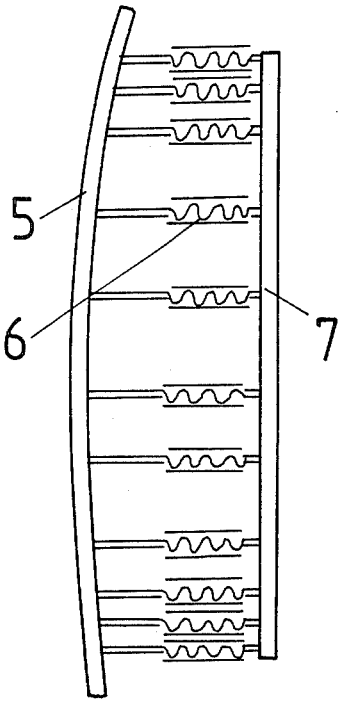
Figure 16:
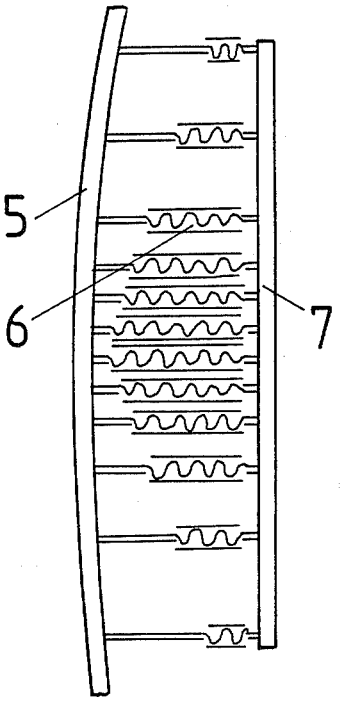

FIGS. *9a–9i* illustrate different embodiments of the yoke-shaped beams;

FIG. 10 is an embodiment showing in a perspective view a modified version of the yoke-shaped beam;

FIG. 11 illustrates in a side view of cut away portions of the system of this invention various embodiments of the pressing elements in combination with force indicators;

FIG. 12 illustrates in greater detail examples of intermediate spring elements;

FIG. 13 shows an example of the arrangement of intermediate spring elements;

FIG. 14 shows another example of the arrangement of intermediate spring elements for damping the effects of thermal arching of the yoke-shaped beams;

FIG. 15 is a variation of the arrangement of the intermediate pressing elements;

FIG. 16 is another modification of the arrangement of the pressing elements.

DESCRIPTION OF THE PREFERRED EMBODIMENTS

Figure 1:
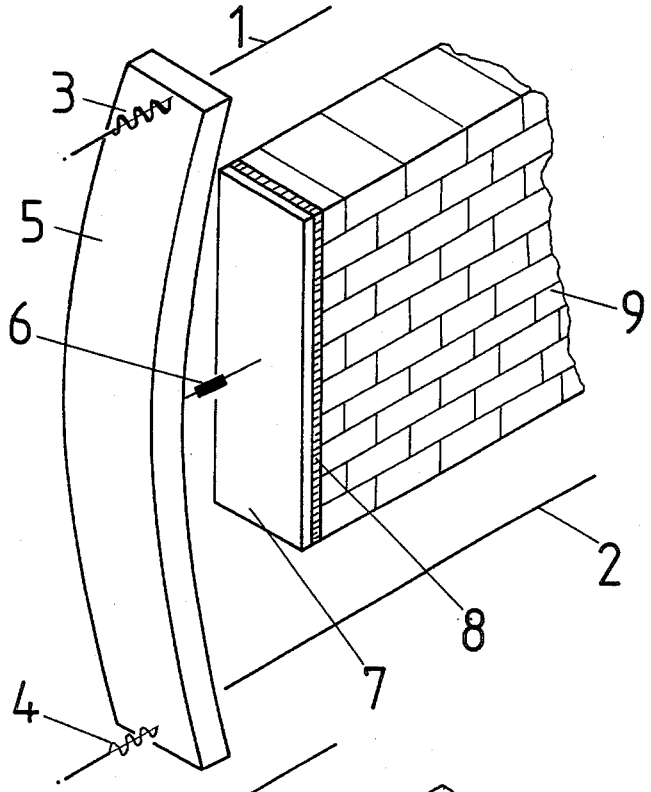
FIG. 1 is a perspective view of a cut away part of a clamping system with a single pressing element.
Figure 2:
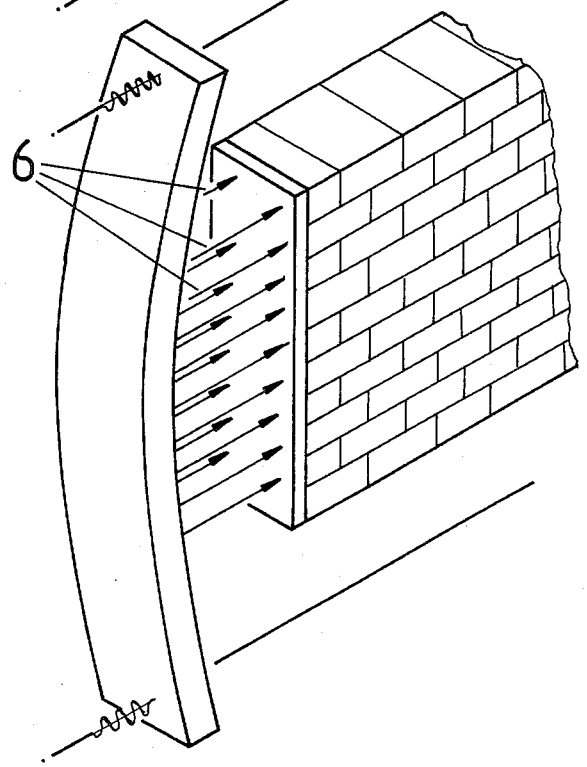
FIG. 2 is a clamping system similar to FIG. 1, but with two rows of up to nine pressing elements.
Figure 3:
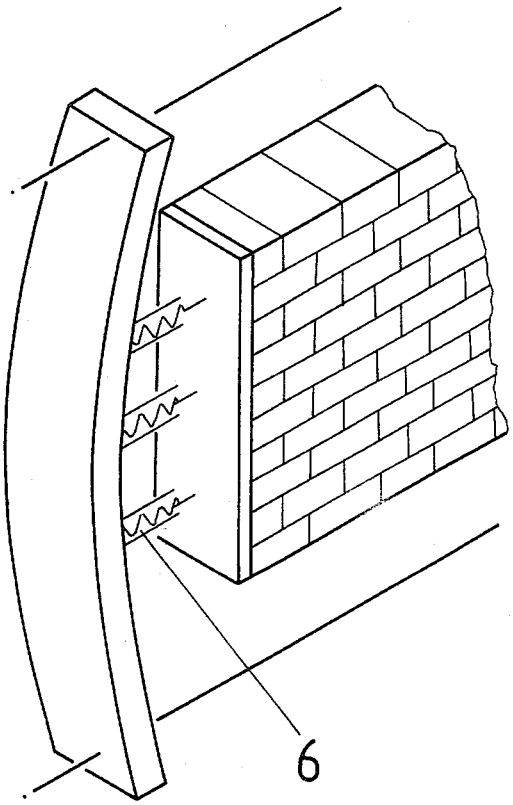
FIG. 3 is similar to FIG. 1 but shown with three intermediate spring elements.
Figure 4:
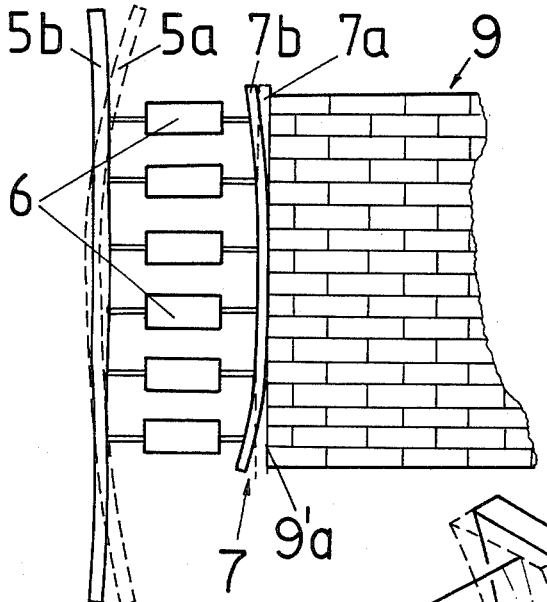
FIG. 4 is a side view of an embodiment of the clamping system of this invention, illustrating the deformations of the yoke-shaped beam and of the clamping plate in the case of disturbances.

Referring firstly to FIGS. 1–7, there is schematically illustrated the mutual connection and interrelationship of individual elements of the clamping system of this invention. The following structural elements are used in this embodiment for clamping a heating wall or brick wall partition 9: upper cross tie rod 1, lower cross tie rod 2, upper spring 3 for the cross tie rod, lower spring 4 for the cross tie rod, an upright yoke-shaped beam (or cross tie support) 5, pressing elements 6 in the form of spacer pieces, bolts, spring pieces and the like for transmitting clamping forces; clamping plates 7 in the form of wall protecting plates, armor plates and the like; and insulating parts 8 such as sealing layers, fiberboards, and the like. Yoke-shaped *5a* beam and the clamping plate *7a*, before their deformation, are illustrated in FIGS. 4 by dashed lines *5a* and *7a*, while the deformation by interfering influences such as increasing temperature gradients or the expansion of the upper cross tie rod 1 is illustrated by full lines *5b* and *7b*. Cross tie rods 1 and 2 apply tensile stresses against the ends end partitions 5' and 5" of the yoke-shaped beam 5 through tension springs 3 and 4 and the beam 5 presses against the clamping plate 7 through the intermediate pressing elements 6.

Figure 5:
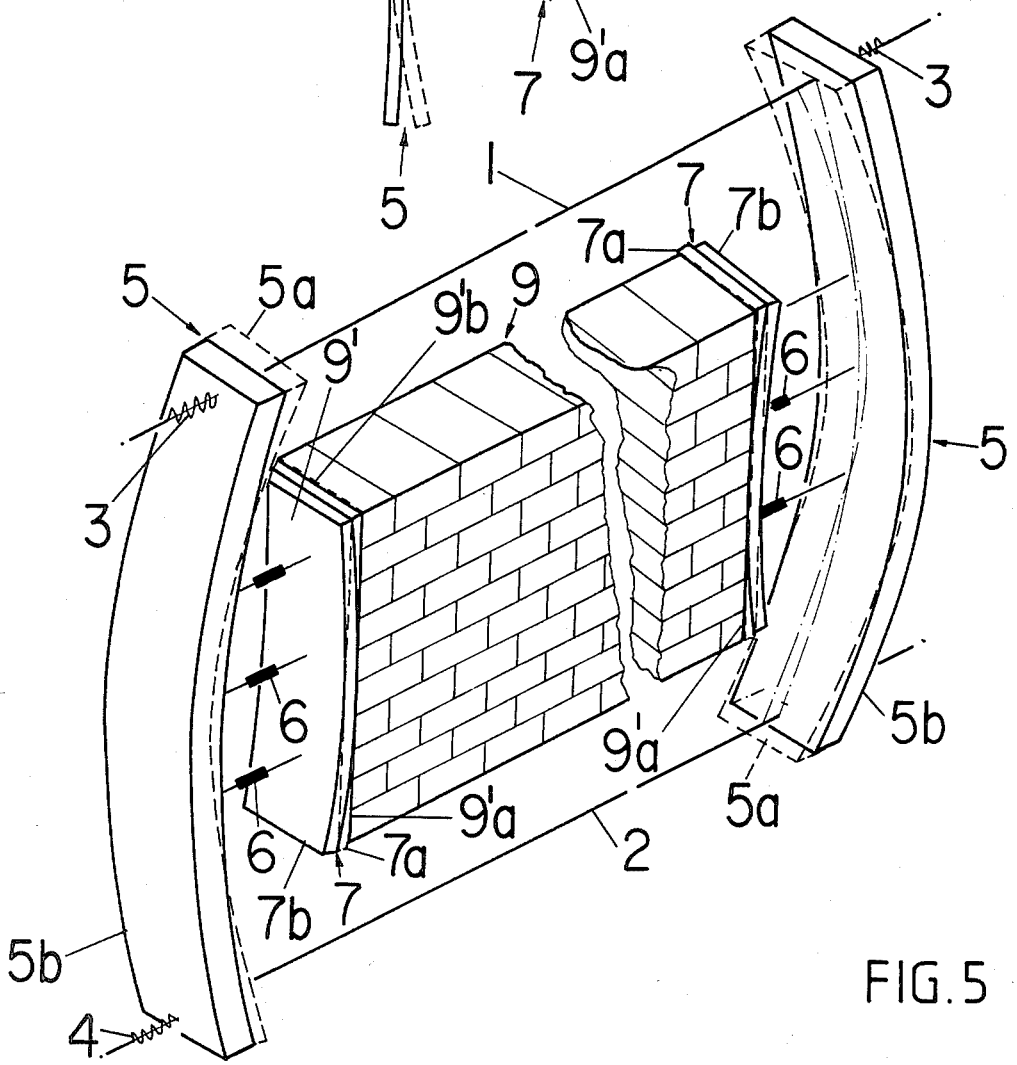
FIG. 5 is a perspective view of a system of this invention with indicated deformations of the beam and of the clamping plate.
Figure 6:
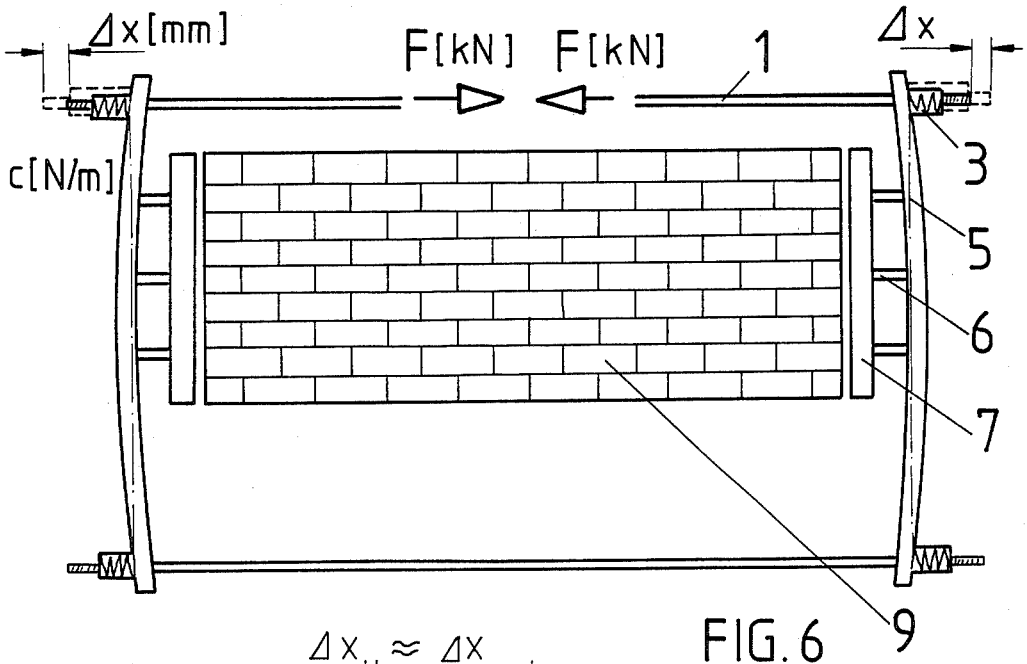
FIG. 6 is a side view of the system of FIG. 5.

As seen from FIGS. 4, 5 and 6, deformations *5b* and *7b* of the beams 5 and of the clamping plates 7 with respect to the initial shape *5a* and *7a* have the same effect as a prolongation of the cross tie rods 1 and 2 or a decrease of forces f introduced by these cross tie rods. The deformation is caused primarily by thermal effects due to the temperature gradient from the interior of the furnace, and this temperature difference varies according to operational conditions and according to ambient temperature.

According to this invention, the prestressing in the brick wall partitions 9 is established directly by the adjustment of the interposed pressing elements 6 installed between the clamping plates 7 and the yoke-shaped beams 5, the installation being carried out with blocked prestressing of these pressing elements and, upon installation, the prestress of these pressing elements is relieved. It is also possible to use adjustable pressing elements between the plates 7 and the beams 5 and adjust the same according to the aforementioned distribution of clamping forces. The bias or prestress acting on the end faces 9' of brick wall partitions 9 is continuously maintained by the elastic quality of the cross tie rods 1, 3, 2 and 4, of yoke-shaped beams 5, of the clamping plates 7 and 8 and of the intermediate pressing pieces 6.

As seen from FIG. 6, the length of the tie rod 1 and thus force F of springs 3 varies proportionally to the unavoidable temperature variations caused for example by rain.

By selecting suitable spring constants, the load variations of conventional clamping forces can be held within the limits of 5 to 20%. The springs 3 and 4 at both ends of the yoke-shaped beams 5 can be combined in a single unilateral spring of a half spring constant when the force variations are transferred from one side to the other.

Figure 7:
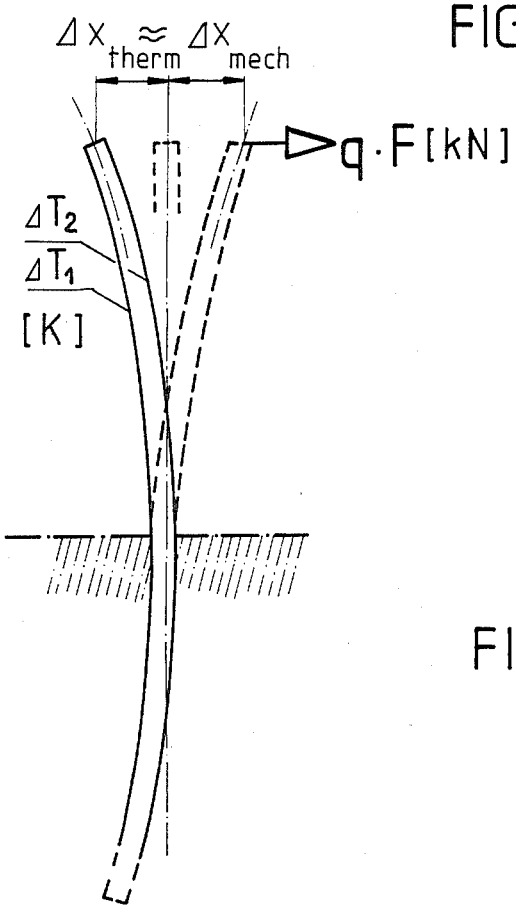
FIG. 7 shows schematically the superposition of additional deformations caused by thermal and mechanical loads, both on the yoke-shaped beams and on the clamping plates.

FIG. 7 illustrates schematically a superposition of additional thermal and mechanical deformations $\Delta_x$ caused by unavoidable deformations in temperature gradients due to introduced temperature ranges $\Delta T_2$ and $\Delta T_1$ and due to changes $\Delta S = q \cdot F$ at point loads F. Factor q amounts to a maximum of 20% of the preset clamping forces. These variations of temperature take place in similar manner both in the yoke-shaped beams and in the clamping plates. The elastic qualities, particularly the angular pulses, are adjusted such that the changes in bending forces indicated by arrows are mutually neutralized at the points of attack of the forces with the allowance of a minute residual displacement, so that $\Delta_x$ thermal equals approximately $\Delta_x$ mechanical.

These adjusted changes of the angular impulses over the the length of the beams or height of the clamping plates should approach as closely as possible to different courses of thermal and mechanical bending lines so as to keep the resulting residual displacement as low as possible.

Figure 8:
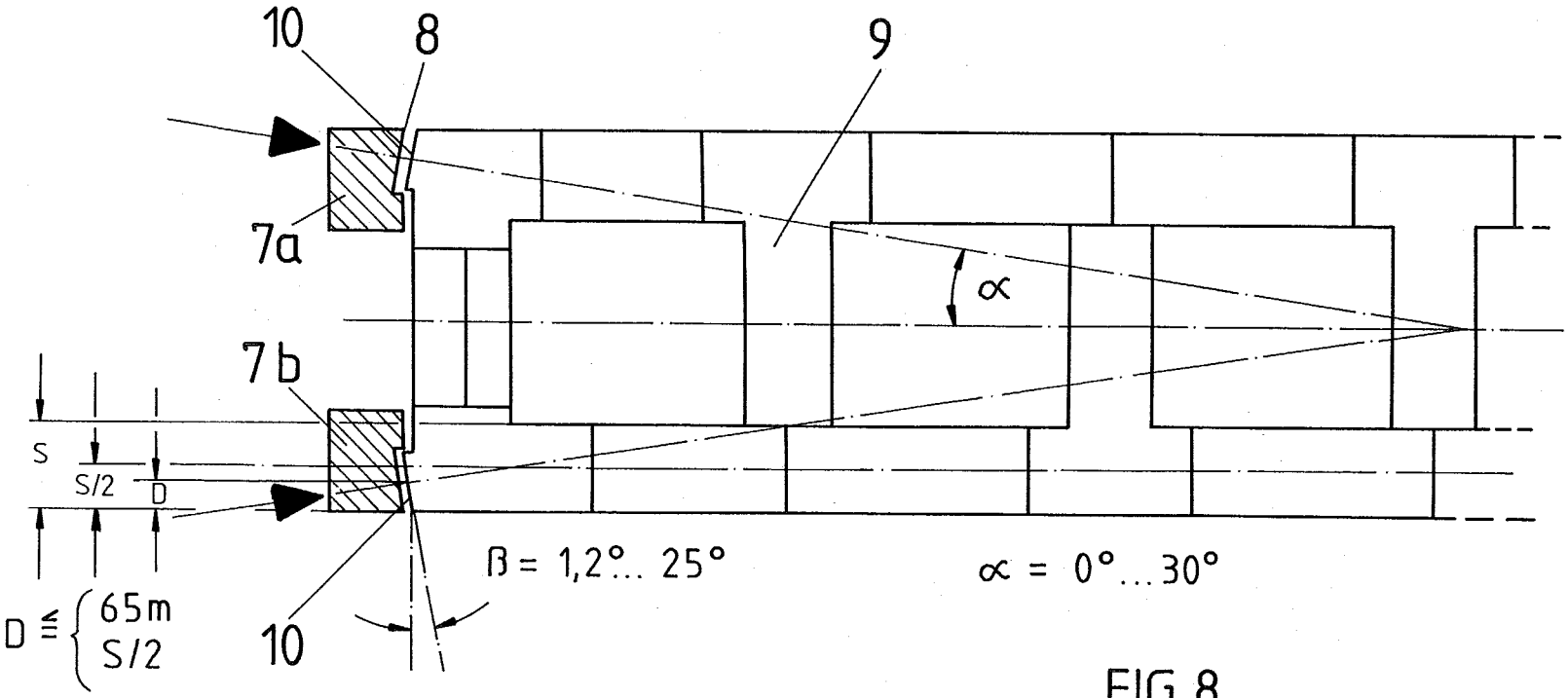
FIG. 8 is a top view, partly in section, of a brick wall plate with adjoining clamping plates for introducing the clamping forces.

FIG. 8 illustrates schematically the layout of resultants of force vectors of the applied clamping forces when using a split clamping plate composed of parts 7a and 7b acting against contact surfaces 10 of the brick wall partition 9. The gaps between the contact surfaces are filled with pliable insulating layers 8. Forces applied in the direction of the arrows can extend either parallel to a central plane of the brick wall partition 9 $\alpha$ at an angle or ranging from 0° to 30°. The forces are applied into outer layers D so that the resultants of these forces act within a distance up to 65 mm from the vertical edges at both sides of the brick wall partition.

Figures 9A, 9B, 9C, 9D, 9E:
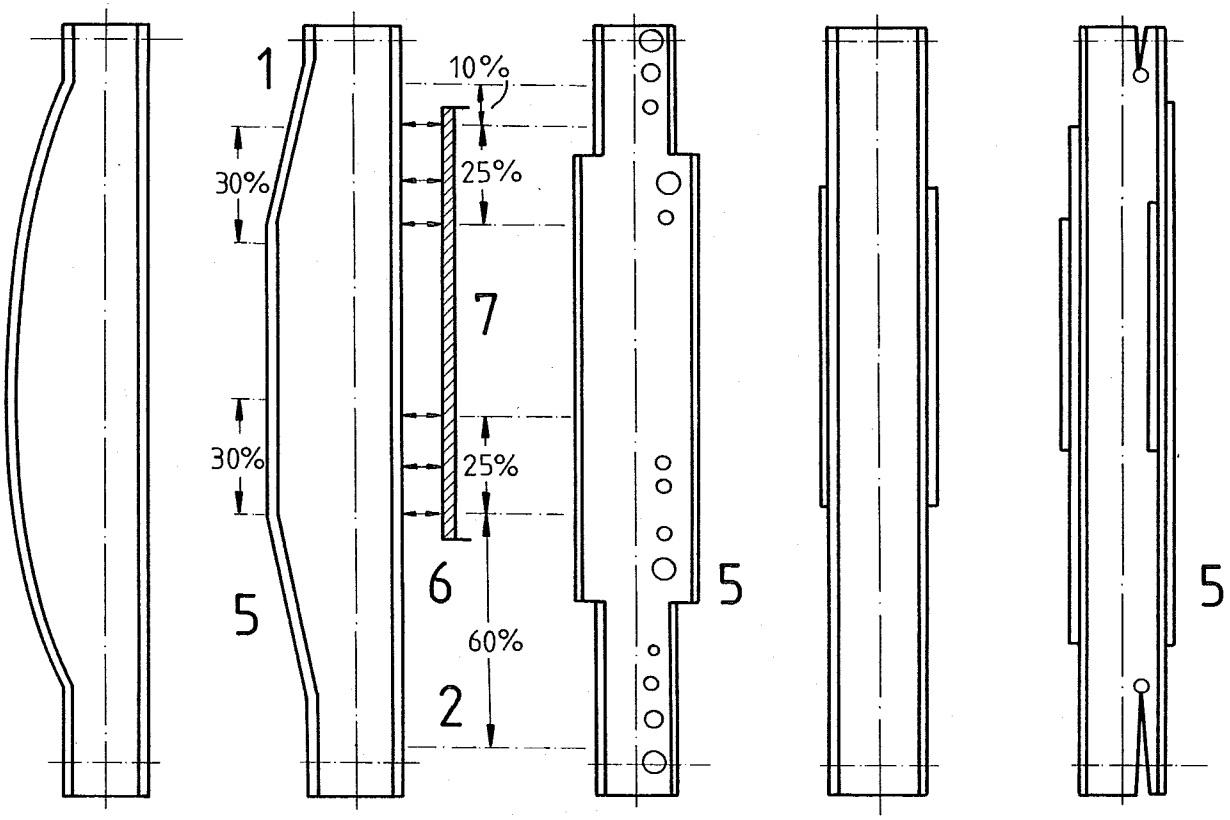
Figures 9F, 9G, 9H, 9I:
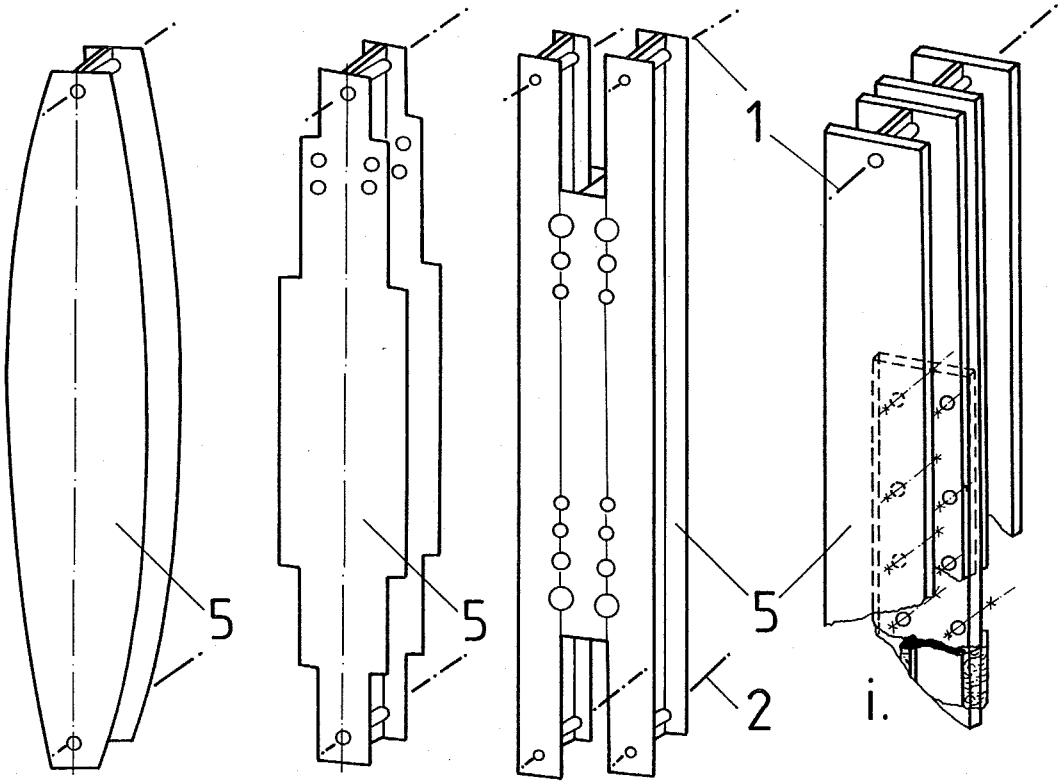

FIGS. 9a through 9i illustrate different configurations of yoke-like beams 5 designed for changing angular impulses of the pulsing forces. The changes are made either by varying the configuration of the beam, for example by assembling the beams of webs of various height (FIGS. 9a, 9b, 9c, 9d) or by perforating or making slots in the webs of the beams (FIGS. 9c, 9g, 9h or 9e) or by providing the webs of the beams with flanges of various strengths FIGS. 9d or 9e) or with flanges of various widths (FIGS. 9f, 9g, 9h) or by combining a plurality of beams of differen profiles (FIGS. 9c and 9i).

FIG. 10 shows another modification of the clamping system of this invention, in which reference numeral 21 denotes a pair of upper cross tie rods which extend immediately below the upper surface of the ceiling 25 of the furnace and are anchored in yokes 22 linked to a lateral side of the yoke-shaped beam 5. Pressing elements 23 for clamping the ceiling 25 are arranged between the yokes 22 and a separate clamping plate section 24 employed for clamping the ceiling 25, whereas another separate section of the clamping plate is used for the brick wall partition. The advantage of this type of construction of the clamping system resides particularly in the fact that a substantially amplified springy effect and energy storing capacity of the yoke-shaped beam is achieved. Moreover, a single beam is employed for the separate clamping sections both in the range of the brick wall partition and in the range of the ceiling of the furnace.

Different embodiments of pressing elements 6 are illustrates in FIGS. 11 and 12. The pressing elements may have the form of spaced bolts 11 interconnected by pressure springs arranged in a casing, whereby the pressure is adjusted by threaded nuts. Pressure indicators 12 are arranged between the casing and the bolt part on the clamping plate 7. In another embodiment, bellows 13 filled with pressurized gas (FIG. 11d) and provided with pressure regulator PC or connected to a position regulator (positioner) are used as the pressing elements. Pressure air consumed by the position regulator can be employed as cooling air and can be discharged at the upper part of the pressurized gas bellows so as to serve as heat-removing medium.

FIG. 12 illustrates an embodiment in which spring-biased pressing elements 6 are employed which are provided with means for blocking (FIG. 12b) and unblocking (FIG. 12a) the spring bias.

FIGS. 13–16 show schematically the arrangement of pressing elements 6 between the beam 5 and the clamping plate 7. The pressing elements in these embodiments are in the form of encased compression springs.

FIG. 13 illustrates a distribution of the pressing element 6 resulting in a bell-shaped characteristic curve of the applied forces, whereby the pressing springs correspond to each other and the clamping plate 7 is relatively flexible.

FIG. 14 illustrates a distribution of clamping forces introduced by different pressing elements 6 of which the elements at the center are softer than those at the ends of the plate 7, the latter being relatively rigid and resistant to bending. In this manner, an approximately constant load against the clamping plate 7 by regrouping of applied forces due to bending of the yoke-shaped beam 5 caused by—variations is obtained.

Similar effects are achievable by varying the spacing between individual spring elements 6 as shown in FIG. 15.

FIG. 16 illustrates an example of combined arrangements of pressing elements 6 according to FIGS. 13–15 which meets the requirement for a bell-shaped plot of the compressing forces and for mitigation of the effects of thermal arching at relatively thin clamping plates. Spring constant $C_m$ (in kN/m) of the pressing elements are within the range of $$10{,}000[kN] \leqq C_m \cdot H \cdot n \leqq 110000[kN],$$

wherein n is the number of pressing elements and H is the height of the furnace. For example, for n=10 springs, and H=7.2 meters, the following inequality is computed:

$$139 kN/m \leqq C_m \leqq 1528 kN/m$$

angular impulse of or divided from clamping plate is computed from the following unequality:

$$10^{-5}[m^2] \cdot H^2 \leqq n \cdot M \cdot I_m \leqq 10^{-4}[m^2] \cdot H^2$$

wherein M is the number of sections of the clamping plate pressed against the end face of a brick wall section.

From this unequality, the following example of average angular impulse $I_m$ of a single piece clamping plate is computed: (for H=7 meters, n=7 pressing elements or contact points, M=1, clamping plate):

$$7 \cdot 10^{-5} m^4 \leqq I_m \leqq 7 \cdot 10^{-4} m^4.$$

The above expression, for a rectangular clamping plate of b=0.84 meters in breadth corresponds to a thickness of the plate between 0.1 and 0.215 meters.

The average angular impulses $I_m[m^4]$ in clamping plate sections of a length H/M corresponding to a distance $L' = H/2M - 1$ from the center of respective plates to the load points at the ends, continuously or stepwise diminish approximately according to the equation $I=I_m\times 3\times M\times 1/H$. For example, if H=7.2 meters, M=1 plate, b=0.84 the breadth of the plate, and $I_m=22\times 10^{-5}m^4$,

| | | | | | | |
|---|---|---|---|---|---|---|
| Distance from the center (m) | 0 | 1 | 1.2 | 2 | (3) | (3.2) |
| Distance from the upper or lower load transfer point of the plate (meters) (m) | 3.6 | 2.6 | 2.4 | 1.6 | (0.6) | (0.4) |
| Local angular impulse I ($10^{-6}$ $m^4$) | 330 | 238 | 220 | 147 | (55) | (37) |
| Thickness of an equivalent rectangular plate (millimeters). (mm) | 168 | 150 | 146 | 128 | (92) | (80) |

The values in parentheses indicate that in these ranges the deviations (marginal conditions) may be determinative for example for the manufacturability or the additional functions of the clamping system of this invention.

If the yoke-shaped beams or clamping plates are assembled of several parts, then according to static laws the combined angular impulse is determinative. The graduation of the angular impulses can be achieved for example by recesses or perforations in the beams or clamping plates.

In FIGS. 17 through 20 beams 5 are illustrated which have the form of rectangular hollow tubes provided with an inner flange 5' facing the clamping plate, and an outer flange 5''. Termperature at the inner flange is indicated by $\theta_i$ and at the outer flange by $\theta_0$. Normally, heat flow due to radiation and convection, as indicated by wavelike arrows, undergoes reflections in the interior of the beam 5. (FIG. 17*a*).

Figure 17A:
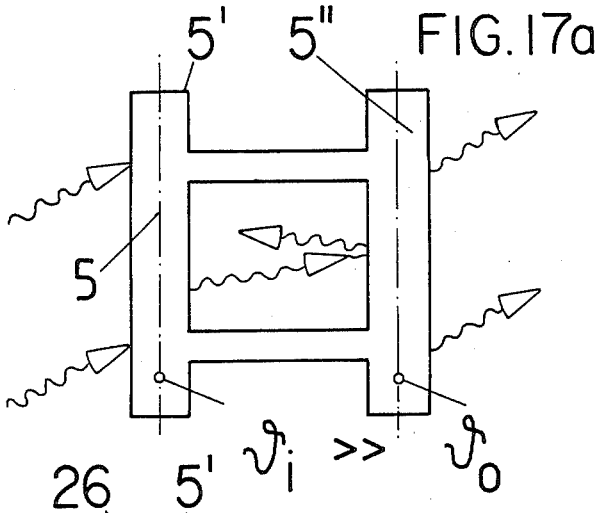
Figure 17B:
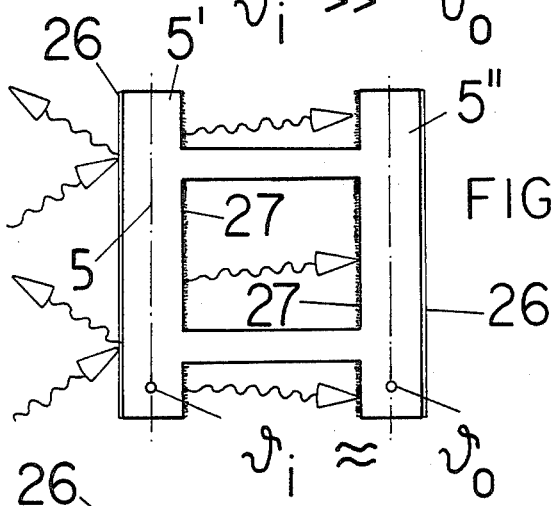
Figure 17C:
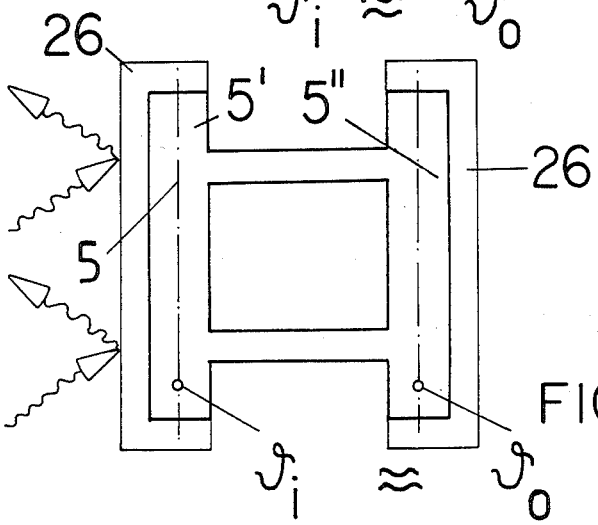

In an embodiment of this invention the outer surfaces of the inner and outer flanges are coated with a heat reflecting layer 26 and the inner surfaces of the flanges are coated with an insulating layer 27 so as to adjust the transmission of heat both by reflection and by convection (FIGS. 17*b*). FIG. 17*c* illustrates insulating layers 26' provided on the outer surfaces of the flanges 5' and 5'' to minimize the heat flow from the brick wall into the outer atmosphere.

Figure 18A:
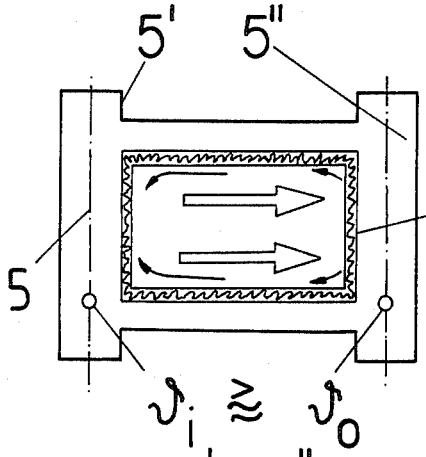

FIG. 18*a* shows an example of the temperature compensation or neutralization by vaporizing and condensing a heat transfer medium in the interior of the beam 5. Preferably, the inner walls of the beam are also provided with a porous heat absorbing coating 27'. A liquid condenses at the cooler ($\theta_0$) outer flange 5'' and flows along the edges of the outer flange toward the hot ($\theta_i$) inner flange. On the inner flange, the liquid vaporizes and transfers its vaporizing enthalpy by means of vapors toward the outer flange, as indicated by arrows in FIG. 18*a*. The return flow of the cooled down liquid is effected either by the force of gravity, or by wick-like capillary effects of the lining 27' or of the outer wall surface.

Figure 18B:
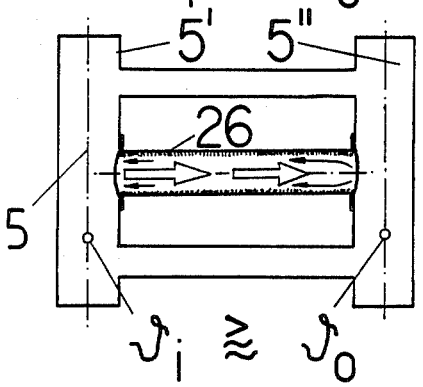

The same functional principle is involved when using a heat pipe 29, as shown in FIG. 18*b*. The ends of the heat pipe are thermally connected to the opposite inner walls of the beam 5 and heat is transferred from the inner flange 5' to the outer flange 5'. As known, due to the high vaporizing enthalpy of heat pipes, correspondingly high density of the heat flow can be attained.

Figure 19:
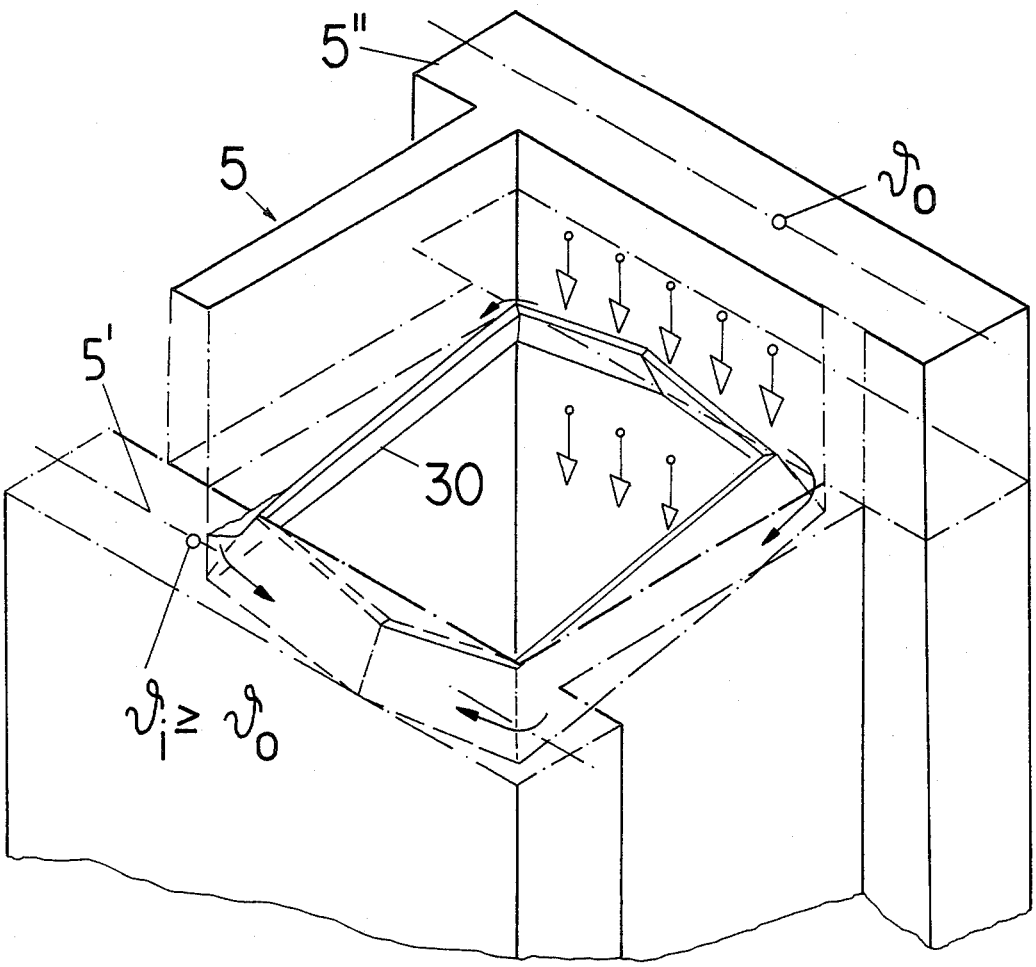

Another version of a temperature compensation is shown in FIG. 19 illustrating the same yoke-like beam as in FIG. 18. Vapor or steam condenses on the inner surface of the outer flange at a temperature $\theta_0$ and the condensate is guided by a chute 30 against the hot inner flange 5' where due to higher temperature $\theta_i$ is vaporized. The chute 30 in the illustrated example is constructed as a single tray of welded metal sheet. In practice, an array of superposed chutes 30 is used. The chutes either communicate with each other or are separated.

FIG. 20*b* shows a vector diagram of the distribution and values of forces F of compressing springs active under normal operational conditions between the beam and a clamping plate.

Due to higher temperature $\theta_i$ of the inner flange 5' when no forces are applied to the beam 5 (FIG. 20*a*), the latter bends in the shown manner. In the same fashion bends the thinner (non-illustrated) clamping plate. By adjusting the elasticity constants of compression springs in the central region between the beam and the clamping plate to desired values, the pulling forces $F_u$ and $F_i$ of the upper and lower cross-tie rods are made effective and act against the thermal bending.

FIG. 20*c* depicts the beam 5 during a contingency when the temperature difference ($\theta_i-\theta_0$) between the inner flange and the outer flange of the beam 5 is zero. This may happen when the beams are exposed to heavy rainfalls, for example. In this case, no bending forces act on the beam and the clamping plate and, consequently, no deformation will occur. As a result, compressing forces F are subject to redistribution with respect to their normal (100%) values. In other words, when $\theta_0=\theta_i$ then the compression springs change their lengths. According to one aspect of this invention, the redistribution of the compressing forces is held within the limits of ±15% with respect to 100%, or normal operational conditions. By virtur of this measure, it is insured that clamping forces acting on the brick wall plate via the clamping plate are still sufficiently large. According to this invention, the elasticity constants of respective compression springs are adjusted such as to permit at most ±15% changes relative to their normal (100§) values.

It will be understood that each of the elements described above, or two or more together, may also find a useful application in other types of constructions differing from the types described above.

While the invention has been illustrated and described as embodied in a clamping system for use in brick wall plates, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a coke-oven-type industrial furnace having a brick heating wall which is subject both to thermal and mechanical operational loads, the heating wall defining opposite vertical end faces, a upright central plane, and horizontal upper and lower edge and vertical edges at each end face, a clamping system for preventing detrimental tensile and shearing stresses in the heating wall, said system comprising at least one clamping plate engaging each said end face of the heating wall, an upright yoke-shaped beam having upper and lower end portions situated above and below said clamping plate and an intermediate portion facing said clamping plate, cross tie rods connected by springs to said end portions of the beam to apply clamping forces thereto, and pressing elements provided between said intermediate portion of said beam and said clamping plate to transfer the clamping forces via said clamping plate into said heating wall, said beam being elastically suspended between said pressing elements and said connecting springs exclusively opposite said heating wall of the furnace and, prior to the application of the thermal and mechanical operational loads, said beam having a substantially convex configuration, and pliable insulating means provided between the mating surfaces of said end face of the heating wall and said clamping plate to compensate local roughness in excess of 2.5 millimeters therebetween, wherein the mutual arrangement of the cross tie rods, the connecting springs, the beam, the clamping plate and the pressing elements being such as to fulfill at least one of the following conditions for the distribution of clamping forces into the heating wall:

(a) clamping forces starting approximately midway between said horizontal edges of each end face of the heating wall decrease toward respective horizontal edges over a length of about 75% of the distance between the horizontal edges according to a bell-shaped or parabolic characteristic curve;

(b) the resultants of the clamping forces when viewed in longitudinal direction of the heating wall act on midlines of two outer marginal areas of the end face within a distance of approximately 65 millimeters from said vertical edges, and the resultants are applied at angles between 0 and 30° relative to said central plane of the heating wall;

(c) the effect of interfering forces in the case of any thermal and/or mechanical disturbance is resiliently held by the cross tie rods, the connecting springs, the beam, the clamping plate and the pressing elements within limits of 5 to 20% of preset clamping forces so as to maintain the desired distribution of the clamping forces over the entire length of the clamping plate.

2. In a furnace according to claim 1, wherein the number n of pressing elements between the beam and the clamping plate is directly proportional to the height H of the heating wall and the pressing elements have elasticity constants $C_m$ within the following limits:

$$10{,}000[kN] \leqq C_m[kN/m],\ H[m]\cdot n \leqq 110000[kN].$$

3. In a furnace as defined in claim 2, wherein the elasticity constants of respective pressing elements is stepped down from the center of the clamping plate to its edges and, depending on the center distance L(m) and height H(m) of the furnace, corresponds approximately to the formula $$C = C_m/(1-4\cdot L^2/H^2)$$

wherein $C_m$ is the spring constant of the elements at the half height of the heating wall or clamping plate.

4. In a furnace as defined in claim 2, wherein the number of spring windings and thus the length of the springs, starting from the center of the clamping plate towards its edges, is reduced by the factor $(1=4\times L^2/H^2)$ whereby all springs have the same spring constant.

5. In a furnace as defined in claim 1, further including temperature neutralizing means for the yoke-shaped beam, said means including heat conductors in the form of closed heat pipes internally located in said beam and operating by vaporizing and condensing a heat transfer medium.

6. In a furnace according to claim 1, wherein said pressing elements are in the form of springs adjustable by screws.

7. In a furnace as defined in claim 1, wherein said pressing elements are in the form of pressurized gas bellows or hydraulic pressurizing elements.

8. In a furnace as defined in claim 1, wherein said pressing elements are in the form of adjustable springs distributed between said beam and said clamping plate.

9. In a furnace as defined in claim 1, wherein said pressing elements are compression springs having a relatively low ridigity, and further including means for blocking the springs in a compressed condition during the installation of said pressing elements between the beam and the clamping plate.

10. In a furnace as defined in claim 9, wherein the length of the pressing elements in unblocked condition is longer than the distance between the beam and the clamping plate.

11. In a furnace as defined in claim 1, wherein said pressing elements are provided with protecting means against heat radiation or flames.

12. In a furnace as defined in claim 1, wherein each said end face has a sloping end surface and said clamping plate has a corresponding sloping surface area inclined within the range of 1.2° to 25°.

13. In a furnace according to claim 1 further including a ceiling, said yoke-shaped beam having an upwardly directed extension and an auxiliary yoke connectable to a cross tie and cooperating with an intermediate pressing element for clamping said ceiling, said auxiliary yoke being linked to said extension.

14. In a furnace as defined in claim 1 wherein said insulating means is a layer of a fibrous material of a thickness of at least one inch before installation.

15. In a furnace as defined in claim 1, where means for temperature compensation are provided on said beam.

16. In a furnace as defined in claim 15, wherein said means for the temperature compensation on the beam includes a first coating having a high radiation absorption, the first coating being provided on the inner surface of the beam and a second coating provided on at least one outer surface portion of the beam having a high radiation-reflecting and/or heat-insulating quality.

17. In a furnace as defined in claim 1, wherein said mating-surfaces are formed with a plurality of grooves and tongues.

* * * * *